US008950628B2

(12) United States Patent
Muderlak et al.

(10) Patent No.: US 8,950,628 B2
(45) Date of Patent: Feb. 10, 2015

(54) THROUGH SURFACE DUAL FUNCTION FLUID DISPENSING SYSTEM

(71) Applicant: Xela Innovations, LLC, Glendale, WI (US)

(72) Inventors: Todd J. Muderlak, Whitefish Bay, WI (US); Kenneth J. Muderlak, Milwaukee, WI (US)

(73) Assignee: San Jamar, Inc., Elkhorn, WI (US)

( * ) Notice: Subject to any disclaimer, the term of this patent is extended or adjusted under 35 U.S.C. 154(b) by 53 days.

(21) Appl. No.: 13/842,495

(22) Filed: Mar. 15, 2013

(65) Prior Publication Data

US 2014/0263427 A1 Sep. 18, 2014

(51) Int. Cl.
*B67D 7/14* (2010.01)
*B05B 11/00* (2006.01)

(52) U.S. Cl.
CPC ..... *B05B 11/3052* (2013.01)
USPC ..... 222/52; 222/25; 222/88; 222/173; 222/135; 222/320; 222/383.1

(58) Field of Classification Search
USPC ..... 222/23, 25, 28, 52, 63, 81, 88, 113, 222/173, 180–181.3, 320–321.9, 383.1, 135
See application file for complete search history.

(56) References Cited

U.S. PATENT DOCUMENTS

| | | | | |
|---|---|---|---|---|
| 5,215,216 | A * | 6/1993 | Van Marcke | 222/1 |
| 5,413,251 | A * | 5/1995 | Adamson | 222/129 |
| 6,131,587 | A * | 10/2000 | Chardack et al. | 134/95.2 |
| 7,455,197 | B2 * | 11/2008 | Ophardt | 222/190 |
| RE42,005 | E | 12/2010 | Jost et al. | |
| 8,051,507 | B2 | 11/2011 | Lin | |
| 8,668,118 | B2 * | 3/2014 | Tsai et al. | 222/325 |
| 2004/0238660 | A1 * | 12/2004 | Fan et al. | 239/310 |
| 2009/0166381 | A1 * | 7/2009 | Phelps et al. | 222/180 |
| 2009/0266842 | A1 * | 10/2009 | Snodgrass | 222/52 |
| 2011/0186594 | A1 * | 8/2011 | Parker | 222/52 |
| 2012/0152976 | A1 * | 6/2012 | Yoshida et al. | 222/81 |
| 2012/0241470 | A1 * | 9/2012 | Snodgrass et al. | 222/63 |
| 2014/0124531 | A1 * | 5/2014 | Muderlak et al. | 222/36 |

* cited by examiner

*Primary Examiner* — Patrick M Buechner
(74) *Attorney, Agent, or Firm* — Boyle Fredrickson, S.C.

(57) ABSTRACT

A through surface hybrid apparatus for dispensing a fluid either in an automatic mode or a manual mode.

16 Claims, 23 Drawing Sheets

THROUGH SURFACE DUAL FUNCTION FLUID DISPENSING SYSTEM

FIELD

Embodiments of this disclosure relate to a hybrid dispenser apparatus for dispensing a fluid in either an automatic mode or a manual mode.

BACKGROUND

In many washrooms, dispensers that are automatically activated are often installed in sinks to dispense soap or other liquid to users for hands-free washing, which eliminates problems with contacting germs, particularly in public facilities. Such automatic dispensers are generally designed with an infrared or other sensor to detect the user's hands under the dispenser spout. However, oftentimes the batteries or power supply ends and/or the electronics are defective and the dispenser fails to automatically respond.

In dispensing other fluids such as ketchup, mustard and other condiments, manual push-down dispensers are often used, which can not only lead to exposure to germs but can also be cumbersome to operate, particularly when the user is trying to manipulate the dispenser while balancing a plate full of food.

It would be desirable to provide a fluid dispensing apparatus that overcomes such drawbacks related to hygiene, exposure to germs, difficulty of use and the user's inability to access liquids when power ends, and can be easily installed and used.

SUMMARY

Embodiments of the present disclosure provides a dispenser apparatus for dispensing a fluid material, for example, liquid soap, foamed soap, lotion, cream, condiments such as ketchup, mustard and mayonnaise, sanitizers, and other fluids.

In an embodiment, the disclosure provides an apparatus for automatically and manually dispensing a fluid, comprising a spout assembly mounted through a support substrate and connected to a fluid pump that is mounted on a fluid container. In embodiments, the spout assembly is structured with a manually activated push element, and comprises a cover section hinged to a base section such that the cover section can be lifted upwardly, with the cover section comprising one or more indicator lights, and the base section comprising an infrared sensor, an exit opening for dispensing the fluid therethrough and a bottom open end mounted on a first end of the fluid pump. In embodiments, the fluid pump comprises a depressible fluid pump (either metered or non-metered), which is connected to an extension tube (or dip tube) configured for insertion into the fluid container. The fluid pump is connected to a drive system that is connected to a power source. The drive system includes an actuator component such as a rod or plate that is configured to engage and depress the fluid pump. The manually activated push element of the cover section is connected to an activation rod that is also connected to the fluid pump. A tubular element connects the fluid pump to the exit opening in the base section of the spout assembly for dispensing fluid from the apparatus.

In an automatic operation, upon actuation of the drive system, the actuator component engages and depresses the fluid pump downwardly to cause an amount of fluid to flow out of the fluid container into the fluid pump and through the exit opening of the spout assembly. In a manual operation, upon manual activation of the push element, the activation rod is move downwardly along a vertical axis to move the fluid pump downwardly to cause an amount of fluid to flow out of the container into the fluid pump and through the exit opening of the spout assembly.

The design of the present dispensing apparatus allows for either method of activation without the risk of breaking or damaging parts. Advantageously, in embodiments, the actuator component activated in the automatic mode and the activation rod activated in the manual mode are not connected and operate independently to actuate the fluid pump of the apparatus for dispensing fluid.

BRIEF DESCRIPTION OF THE DRAWINGS

Preferred embodiments of the disclosure are described below with reference to the following accompanying drawings, which are for illustrative purposes only. Throughout the following views, the reference numerals will be used in the drawings, and the same reference numerals will be used throughout the several views and in the description to indicate the same or like parts.

DETAILED DESCRIPTION

Embodiments of the disclosure relate to a hybrid apparatus and system for automatically and manually dispensing a fluid. The hybrid dispensing apparatus can be mounted on a counter, table, container or other substrate and provides the ability to dispense soap, condiments or other fluid from a container either by automatic dosing (e.g., through use of a motorized drive system) that is activated via an infrared sensor or similar sensor, or by manually dosing (e.g., by moving or depressing a lever, button, the cover of the spout assembly, or other element).

In embodiments, activation of the dispensing apparatus can be conducted with an automatic system using infrared sensors and associated motor/gear train mechanisms, or with a mechanical method using a push handle, button, cover of the spout apparatus that serves as a hinged lever, or other means. The design of the present dispensing apparatus allows for either method of activation without the risk of breaking or damaging parts. Embodiments of the dispensing apparatus further allow for refill containers to be manually replaced or to be refilled from above the counter or other substrate, which eliminates the need to go underneath the counter to install replacement refill containers. In addition, in embodiments, upon batteries (used as a power source) being depleted and too low to activate the automatic dosing mechanism, a system of indicators (e.g., LED lights) can be used to inform the user that the mechanical (push) mode is required for use.

Figure 1:
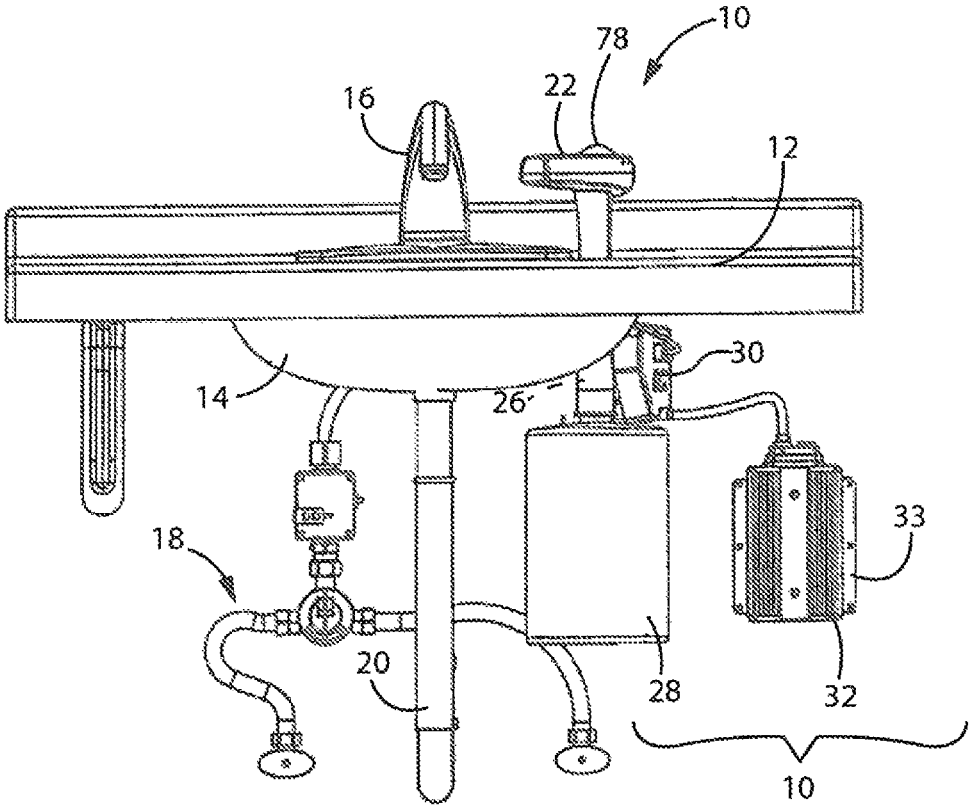
FIG. 1 is a front view of an embodiment of a fluid dispensing apparatus according to the disclosure mounted on the counter of a sink.

An embodiment of a hybrid fluid dispensing apparatus 10 according to the disclosure is described with reference to FIGS. 1-9. Referring to FIG. 1, in the depicted embodiment, the fluid dispensing apparatus 10 is shown mounted through a counter 12 of a sink 14 as a side mount adjacent to a water faucet 16, and in an exploded view in FIG. 2. Also depicted are a water valve and mixer assembly 18 for automatic hot and cold water delivery to the water faucet 16, and a standard plumbing drain 20 connected to the sink 14.

The fluid dispensing apparatus 10 comprises a spout assembly 22 mounted through a hole 24 in the counter 12. The spout assembly is connected to a fluid pump 26 that is releasably mounted on a fluid container 28, which are positioned under the counter 12. The fluid pump 26 is connected to a drive system 30, which is connected to a power source 32 such as a battery, which can be affixed within a bracket 33 that is mounted on a wall beneath the sink counter 12.

The spout assembly 22 comprises a cover section 34 and a base section 36. The cover section 34 is structured with LED indicator lights 38*a*, 38*b* positioned on the inside surface underneath a translucent covering 40. In embodiments, the spout assembly 22 is structured with a plurality of LED indicator lights 38*a* in an array and optionally colored, for example, to indicate power, low fluid level (or low refill) and/or a low battery. In embodiments, the spout assembly 22 includes a mechanism to ensure that the cover and base sections are secured together. For example, referring to FIGS. 4-6, the cover 34 can include holes 41*a* sized to receive a proprietary key therein to release an locking mechanism 41*b* housed within the cover 34 to release the cover 34 from the base section 36.

Figure 8:
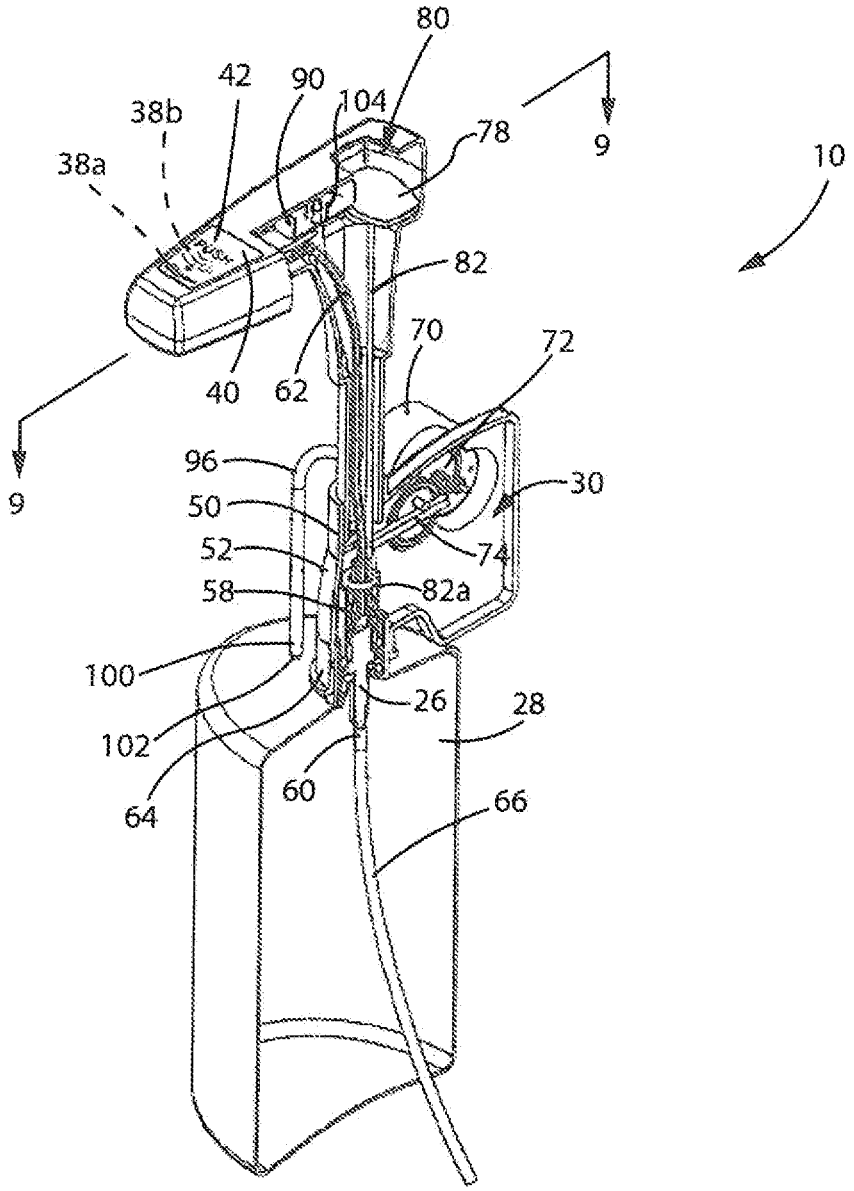
FIG. 8 is a partial cross-section view of the fluid dispenser apparatus of FIG. 4 showing the push element in a downward position for a manual actuation of the apparatus.

As shown in FIG. 8, in embodiments, the covering 40 comprises markings or a decal 42, which include a symbol or wording to indicate a manual mode of operation (e.g., the word "push") with the LED indicator light 38*b* positioned underneath to illuminate the overlying symbol or wording.

The base section 36 of the spout assembly 22 is structured with an exit opening 44 for dispensing the fluid therethrough and an infrared sensor 46 for sensing hand motion. The infrared sensor 46 is situated to optimize 'object in view' performance and minimize accidental dosing of the fluid. The base section 36 has a bottom open end 48 that is structured for connection onto a first open end 50 of the housing 52 for the fluid pump 26.

The LED indicator lights 38*a*, 38*b*in the cover section 34 and the infrared sensor 46 in the base section 36 of the spout assembly 22 are connected via wiring 53 to a processor (PCB) 54 which, in turn, is connected to the power source 32. The processor 54 can he programmed with the number of pumps of the fluid pump 26 that are required to empty the fluid from the fluid container 28, e.g., according to the size of the metered fluid pump 26 and the size (volume) of the container 28, and to count the number of times (pumps) that the fluid pump 26 is actuated to determine the remaining volume of fluid, and generate signals to activate or turn off the indicator lights 38*a*, 38*b*. The processor can also be configured to detect a low power level and activate indicator lights 38*a*, 38*b*to indicate low power and/or a manual mode of operation, e.g., by illuminating a "push" decal. The processor 54 is configured to communicate with the IR/LED indicator lights 38*a*, 38*b* via wire 53 to turn on and off the drive system when. the IR sensor 46 is or isn't activated.

The processor 54 can be connected to external switches and indicator lights 56 on the housing of the drive system 30. In embodiments, the system electronics can include a three-prong switch to provide the user with the option of a single or double pumping option, a reset button which can be pushed when a new refill container 28 is installed to ensure a count that is accurate and a "low refill" LED indicator light 38*a* properly functions, LED indicator lights to indicate power and low refill status, an LED indicator light to indicate low batteries, and/or a plug for connecting the electronics to an outlet.

The second open end 64 of the housing 52 for the fluid pump 26 is structured for connection onto the open end 65 of the fluid container 28. The connection between the second open end 64 of the fluid pump housing 52 and the open end 65 of the fluid container 28 can be configured with an internal fastening feature for matingly engaging an external fastening feature on the end of the refill container, for example, matingly engaging threads or a bayonet mount construction.

In embodiments, the fluid pump 26 is a depressible pump that is operable to dispense fluid therethrough, for example a metering pump as generally known and used in the art.

Figure 7:
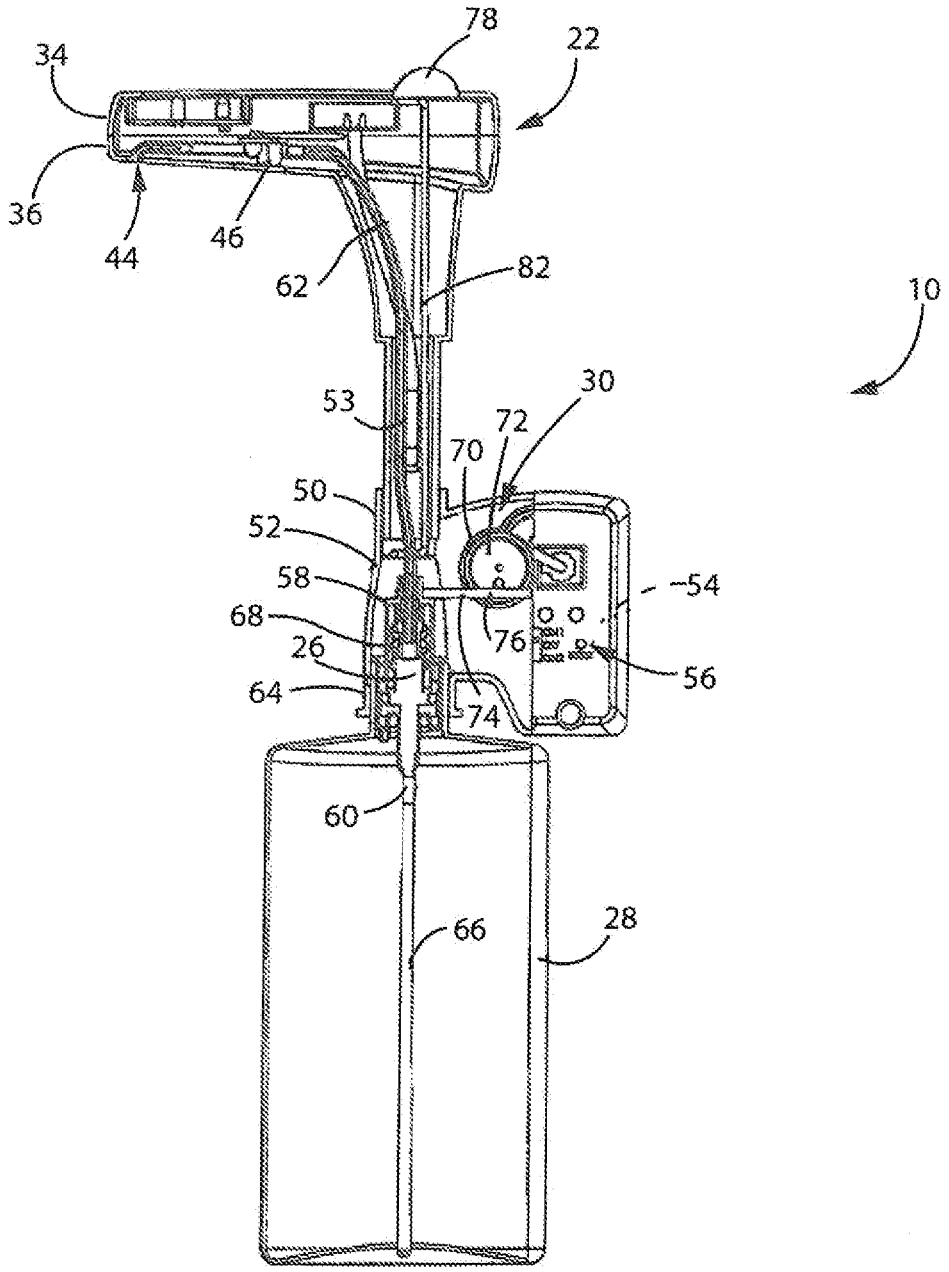
FIG. 7 is a view of the fluid dispensing apparatus of FIG. 6 showing a second position of the actuator component of the drive system in an automatic mode.

A first end 58 of the fluid pump 26 is connected to an extension tube 62, which is connected at the exit opening 44 of the base section 36 of the spout assembly 22. The second end 60 of the fluid pump 26 is connected to another extension tube (or "dip tube") 66 that is inserted into fluid housed within the fluid container 28. As shown in FIG. 7, the apparatus can include a bellows-type component 68 that can be positioned in association with the fluid pump 26 to create a vacuum in the area to draw back excess fluid, foam or the like, after dosing to prevent dripping from the exit opening 44 of the spout.

Figure 4:
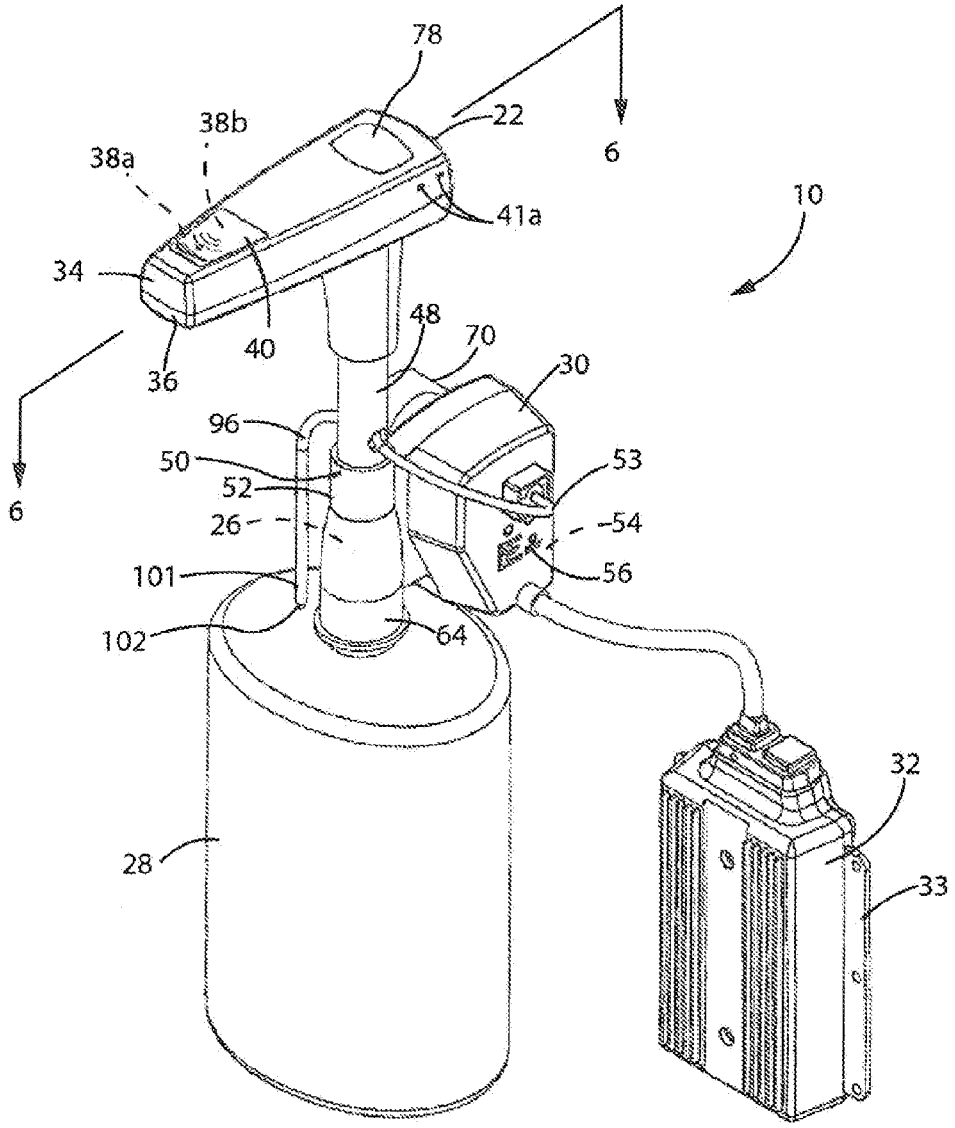
FIG. 4 is a perspective view of the fluid dispensing apparatus of FIG. 1.
Figure 5:
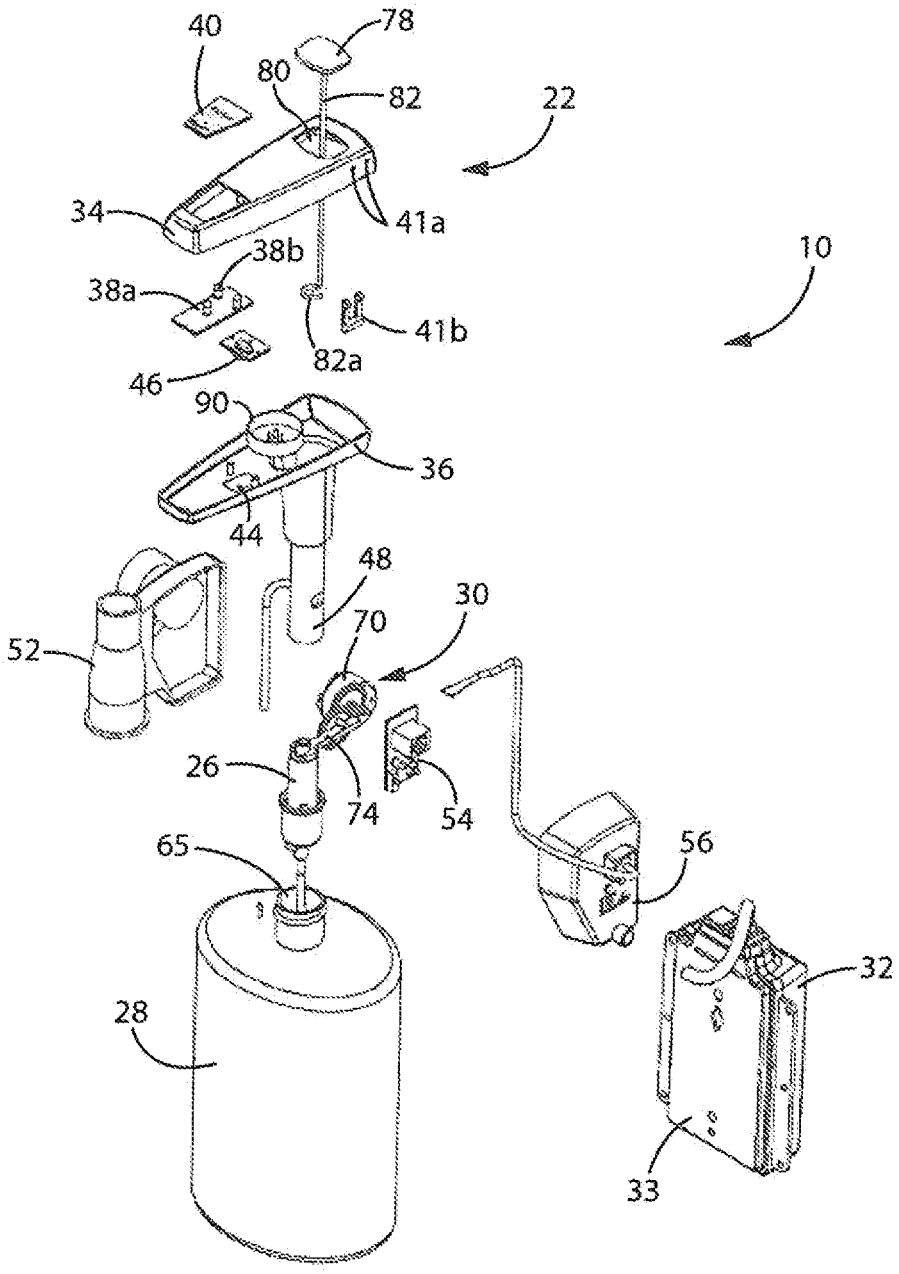
FIG. 5 is an exploded view of the fluid dispensing apparatus of FIG. 4.
Figure 6:
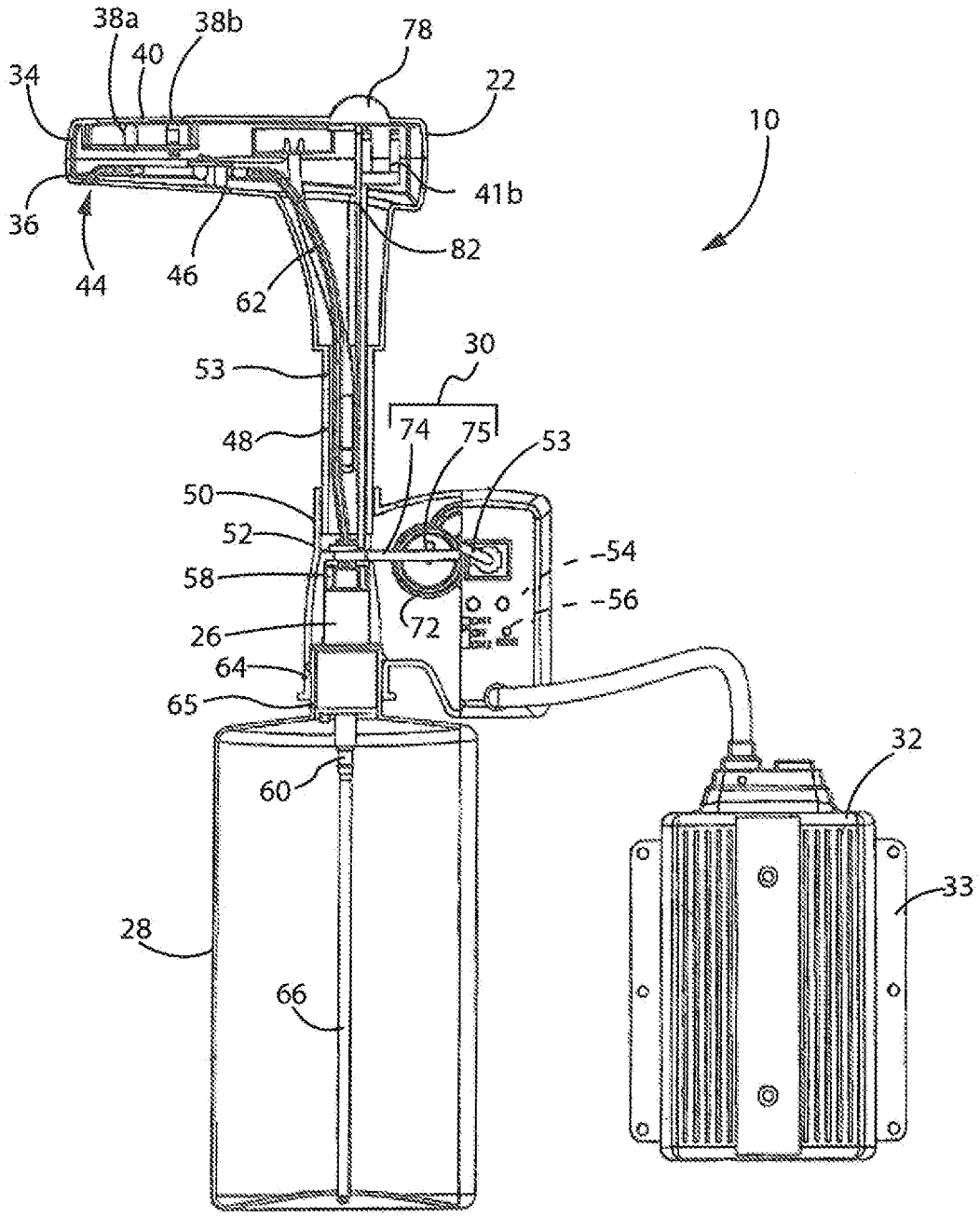
FIG. 6 is a partial cross-sectional view of the fluid dispensing apparatus of FIG. 4 taken along lines 6-6, showing a first position of the actuator component of the drive system in an automatic mode.

The fluid pump 26 is connected to the drive system 30 that is connected to the power source 32. As illustrated in FIGS. 4-6, in embodiments, the drive system 30 comprises a motor 70 connected to rotatable gears 72. The gears 72 are connected to an actuator component 74 (e.g.,. a rod or plate), which is in a horizontal plane and in contact with (e.g., encircles) the first end 58 of the fluid pump 26 such that rotation of the gear 72 moves the actuator component 74 horizontally in a downward or upward direction. In embodiments, a gear 72 includes a mate flange 75 which contacts the actuator component 74.

The spout assembly 22 is further structured with a push element 78 exposed through an opening 80 within the cover section 34 for manual activation of the fluid pump 26 to dispense the fluid. The push element 78 is connected to an activation rod 82. The distal end 82*a* of the activation rod 82 is in contact with (e.g., encircles) the first end 60 of the fluid pump 26.

The actuator component 74 and the activation rod 82 are not connected and operate independently to depress the fluid pump 26.

In an automatic operation of the dispensing apparatus 10, the drive system 30 is actuated by passing a hand or other object beneath the infrared sensor 46, causing the gears 72 to rotate and the actuator component 74 and the fluid pump 26 to move in a downward direction (FIGS. 6-7). This action releases an amount of fluid to flow out of the container 28 into the pump 26, through the extension tube 62 and out the fluid exit opening 44 of the spout assembly. In the automatic dosing mode, an LED indicator light 38*a* (e.g., green LED light) in the cover 34 of the spout assembly 22 indicates the power source (e.g., batteries) is functional and fluid (e.g., soap) is dispensed automatically.

Figure 9:
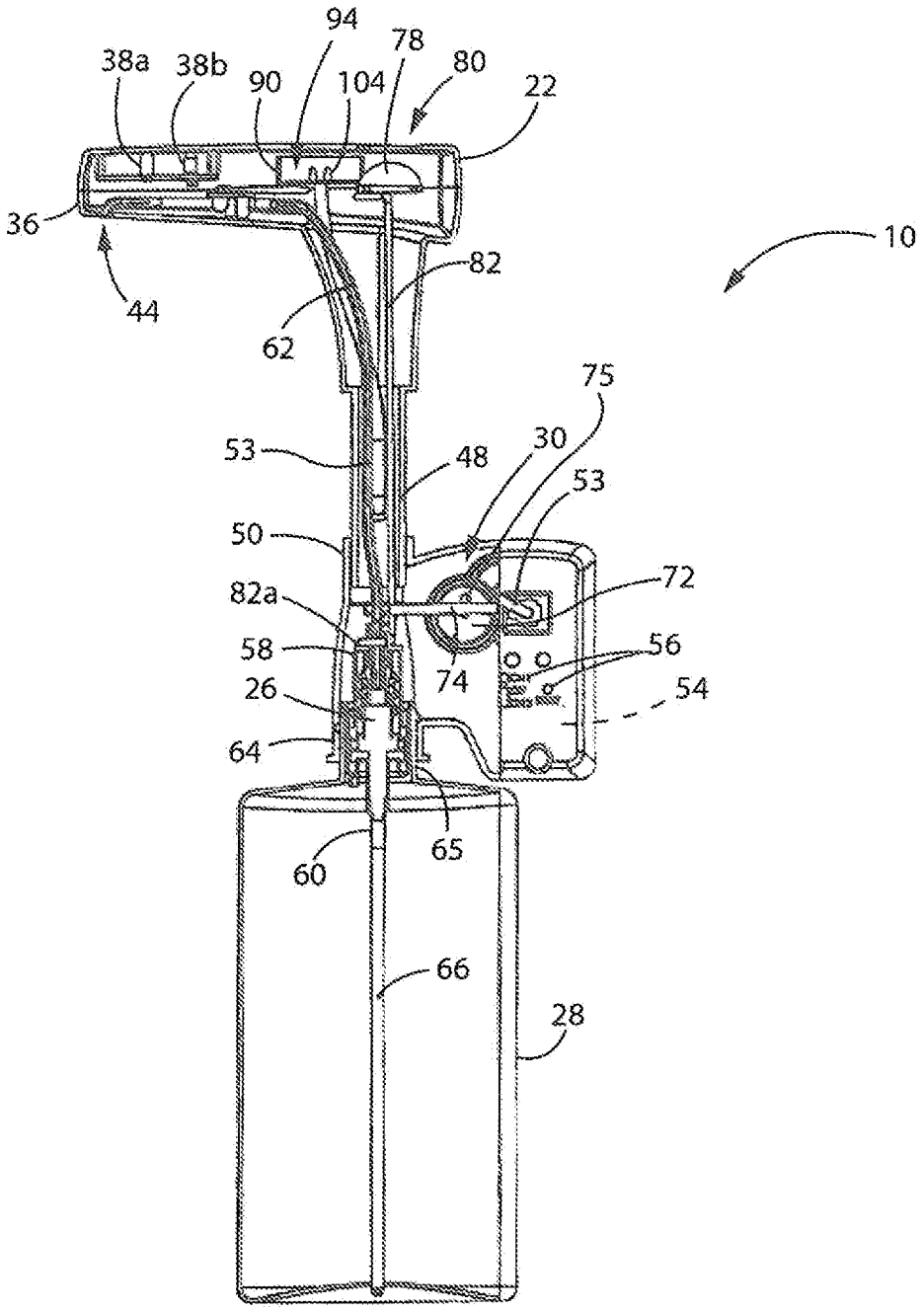
FIG. 9 is a partial cross-section view of the fluid dispensing apparatus of FIG. 8.

When the power source is unable to actuate the drive system 30 to automatically dispense the fluid, a second LED indicator light 38*a* (e.g., red LED light) is activated to indicate the power source is not functional and the LED indicator light 38*b* is activated to illuminate the markings 42 indicating a manual operation (e.g., the word "push"), as illustrated in FIGS. 8-9. The dispensing apparatus 10 can then be manually operated by pushing on and depressing the push element 78 in the cover 34, which moves the activation rod 82 downwardly along a vertical axis to move the fluid pump 26 in a downward direction to release fluid into the pump 26, through the extension tube 62 and out the fluid exit opening 44 of the spout assembly 22.

Figure 10:
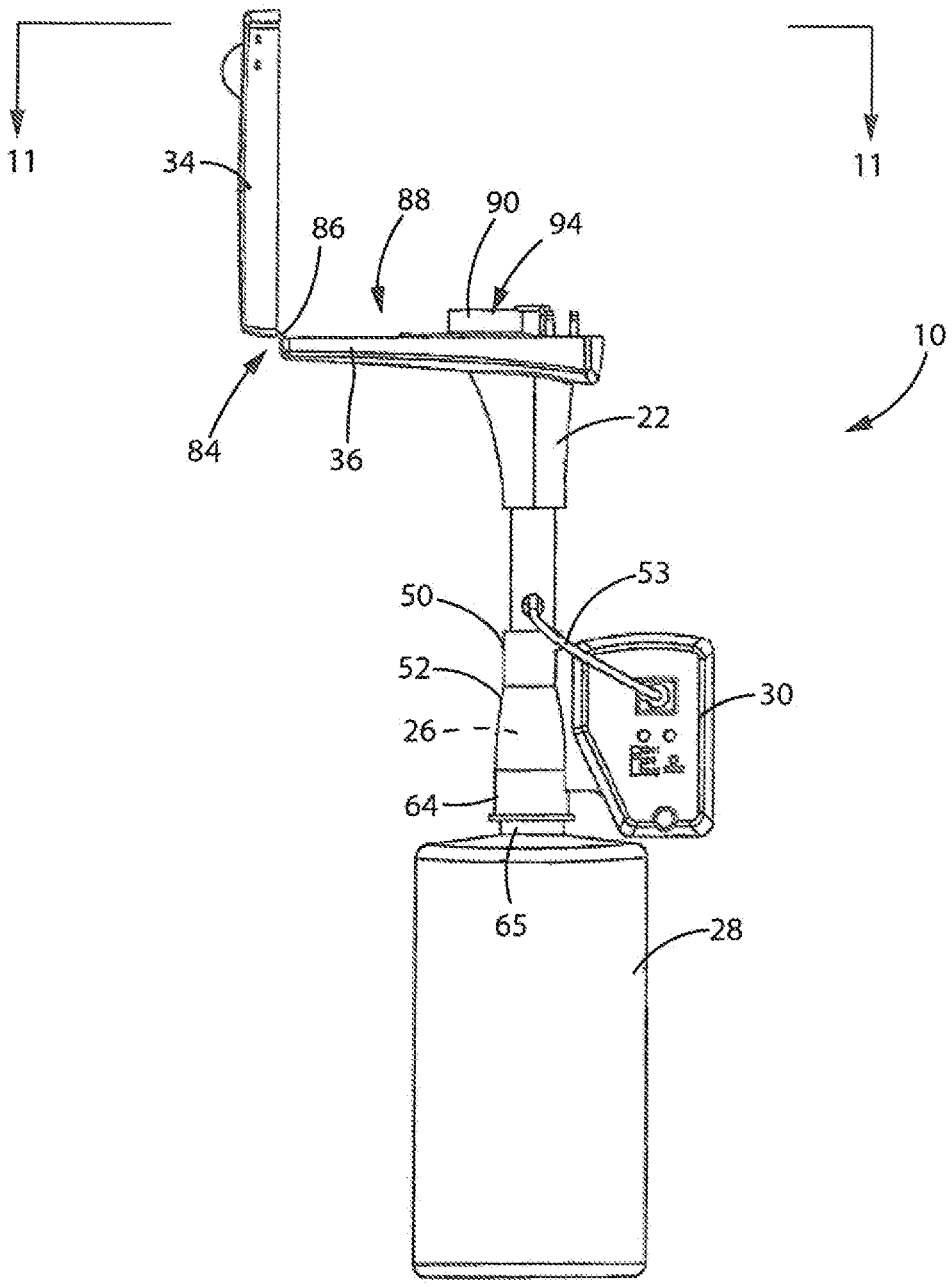
FIG. 10 is a side elevational view of the fluid dispensing apparatus of FIG. 4, showing the cover section raised up.

As illustrated in FIG. 10, in embodiments, the cover section 34 and the base section 36 are connected at the distal end 84 of the spout assembly 22 by a hinge element 86 such that the cover section 34 can be lifted upwardly to expose the interior 88 of the base section 36.

Figure 11:
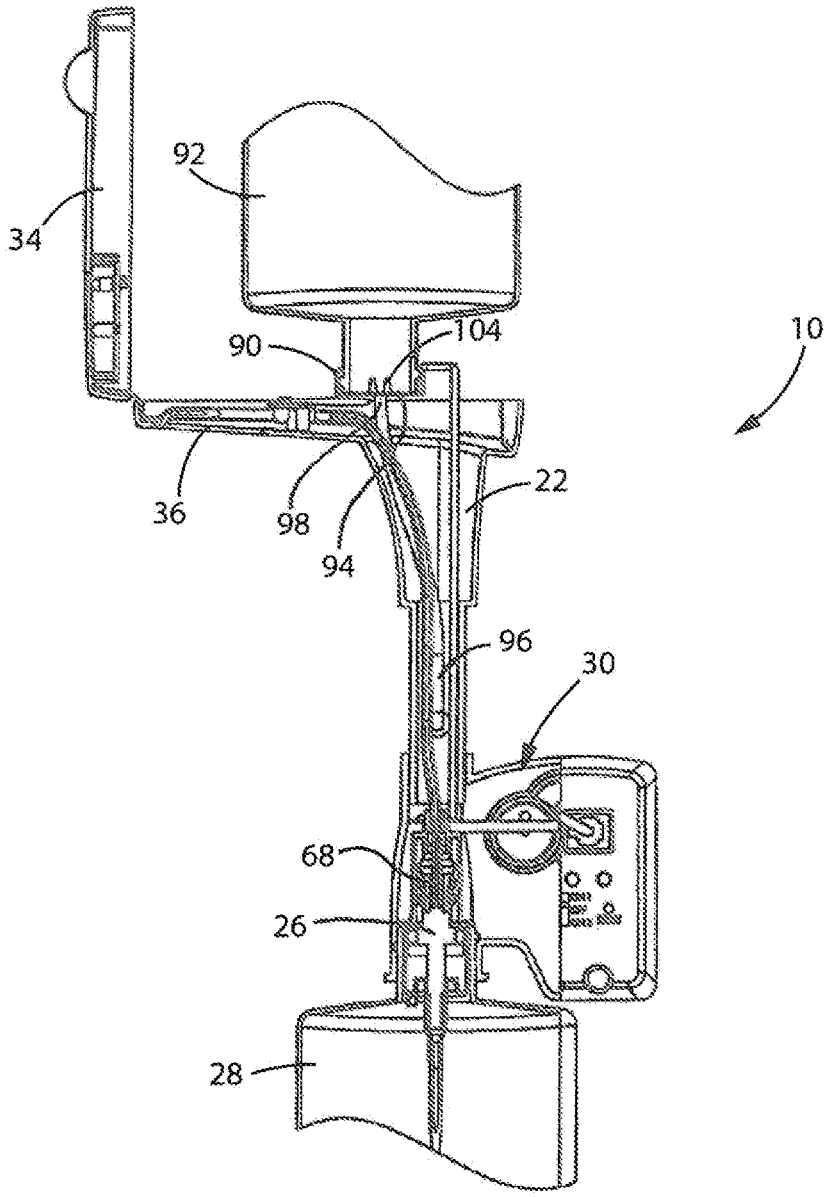
FIG. 11 is a cross-sectional view of the fluid dispensing apparatus of FIG. 10, taken along lines 11-11, and showing a refill container mounted in the refill fluid container for top filing of the fluid receptacle.

Referring to FIG. 10-11, in embodiments, the dispensing apparatus 10 can be structured to include a container seating element 90 positioned within the base section 36 of the spout assembly. The container seating element 90 is configured to receive an end of a refill fluid container 92 therein for easy refilling of the fluid container 28 from above the counter 12 (or other support surface) rather than having to remove and then replace an empty container 28 with a refill 92 from underneath the counter.

The container seating element 90 includes an opening 94 and a tubular element 96 having a first end 98 attached at an opening in the base 94 of the seating element and, as depicted in a perspective view in FIG. 8, a second end 100 attached at an opening 102 into the fluid container 28 for fluid flow therethrough into the fluid container. The container seating element 90 can be configured with an internal fastening feature for matingly engaging an external fastening feature on the end of the refill container, for example, matingly engaging threads or a bayonet mount construction. In embodiments, the container seating element 90 further comprises one or more piercing elements 104, which are configured to perforate/tear a cover (e.g., foil, heat sealed paper, etc.) on the opening of the refill fluid container 92 as the refill container is rotatably mounted within the seating element. With the refill bottle fully in place, the fluid exits the refill container into the tubular element 96 and into the fluid container 28 to replenish the fluid.

Figure 12:
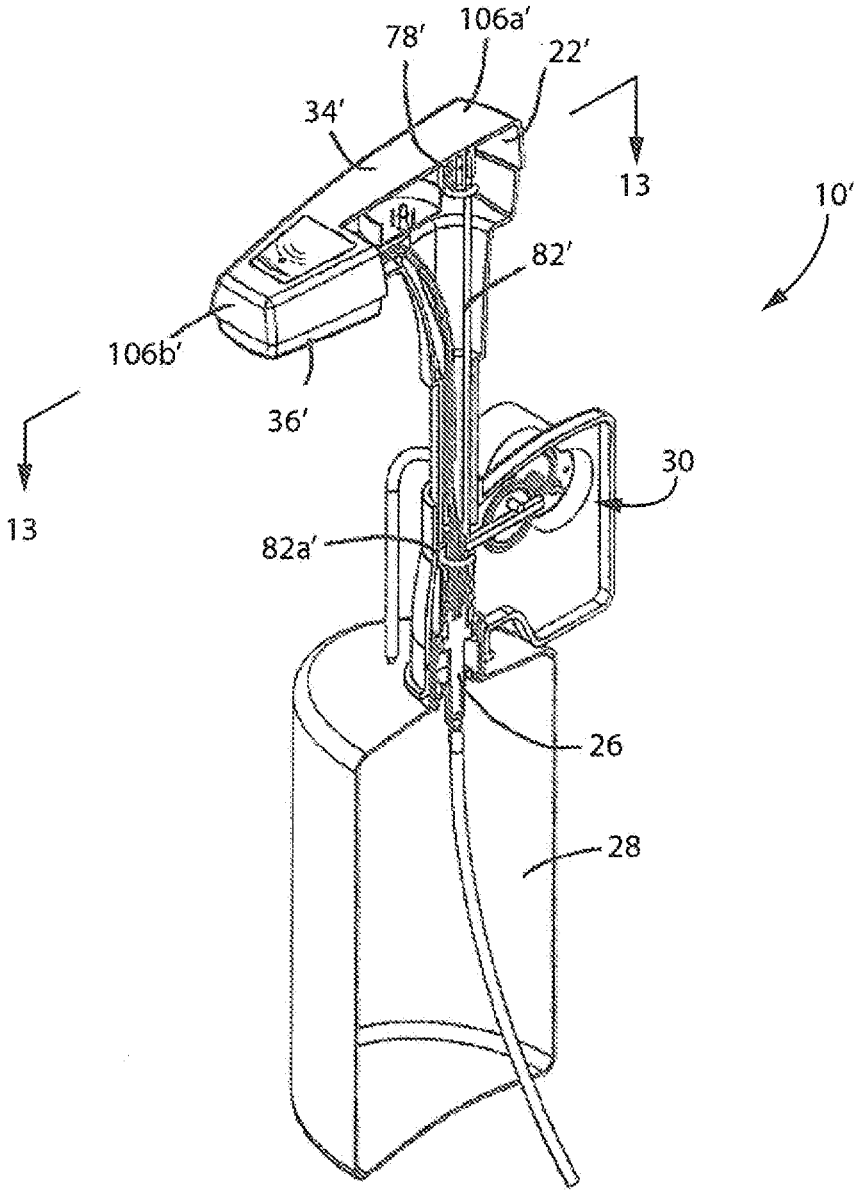
FIG. 12 is a perspective, partial cross-sectional view of another embodiment of a fluid dispensing apparatus according to the disclosure.
Figure 13:
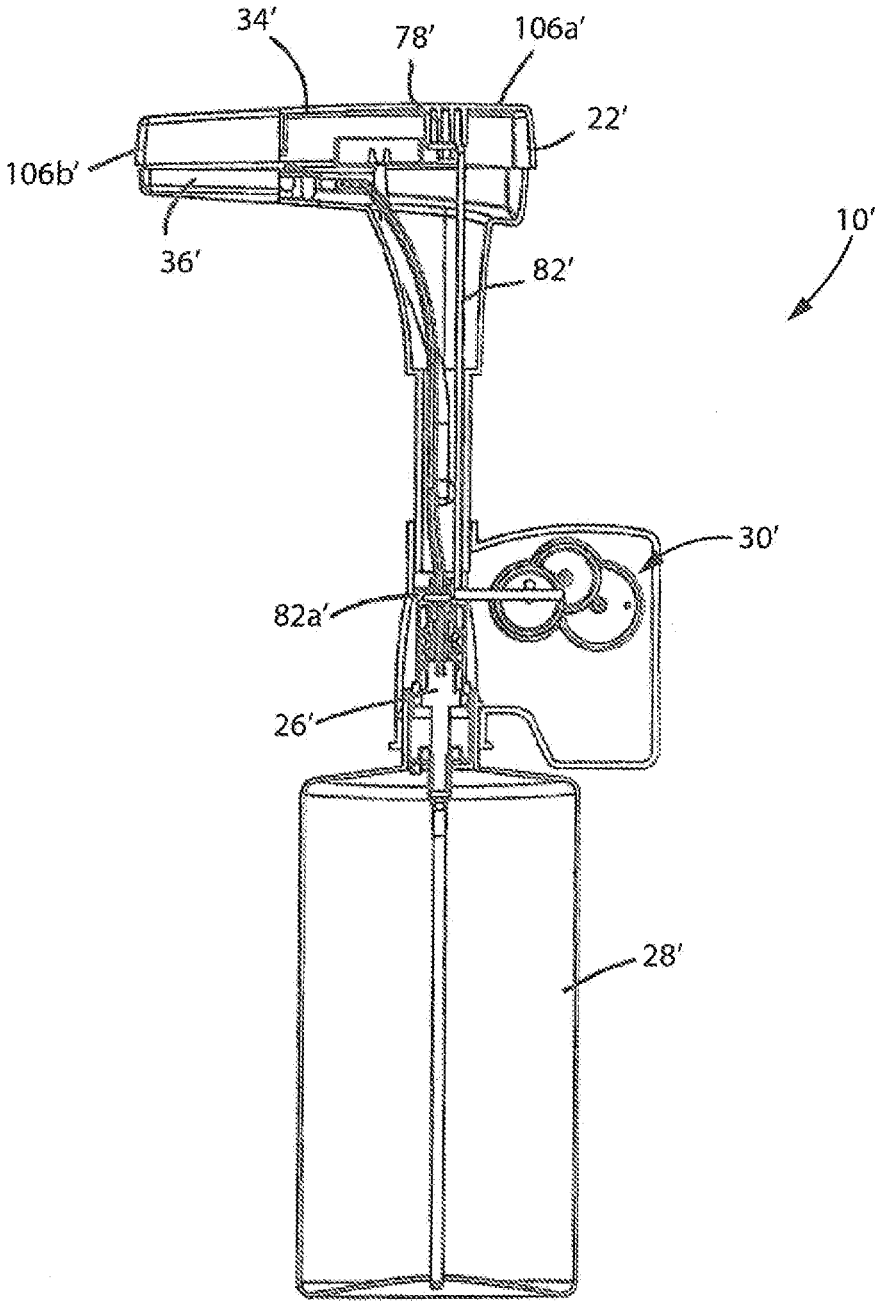
FIG. 13 is a partial cross-sectional view of the fluid dispensing of FIG. 12 taken along lines 13-13, and showing a first position of the actuator component of the drive system in an automatic mode.
Figure 14:
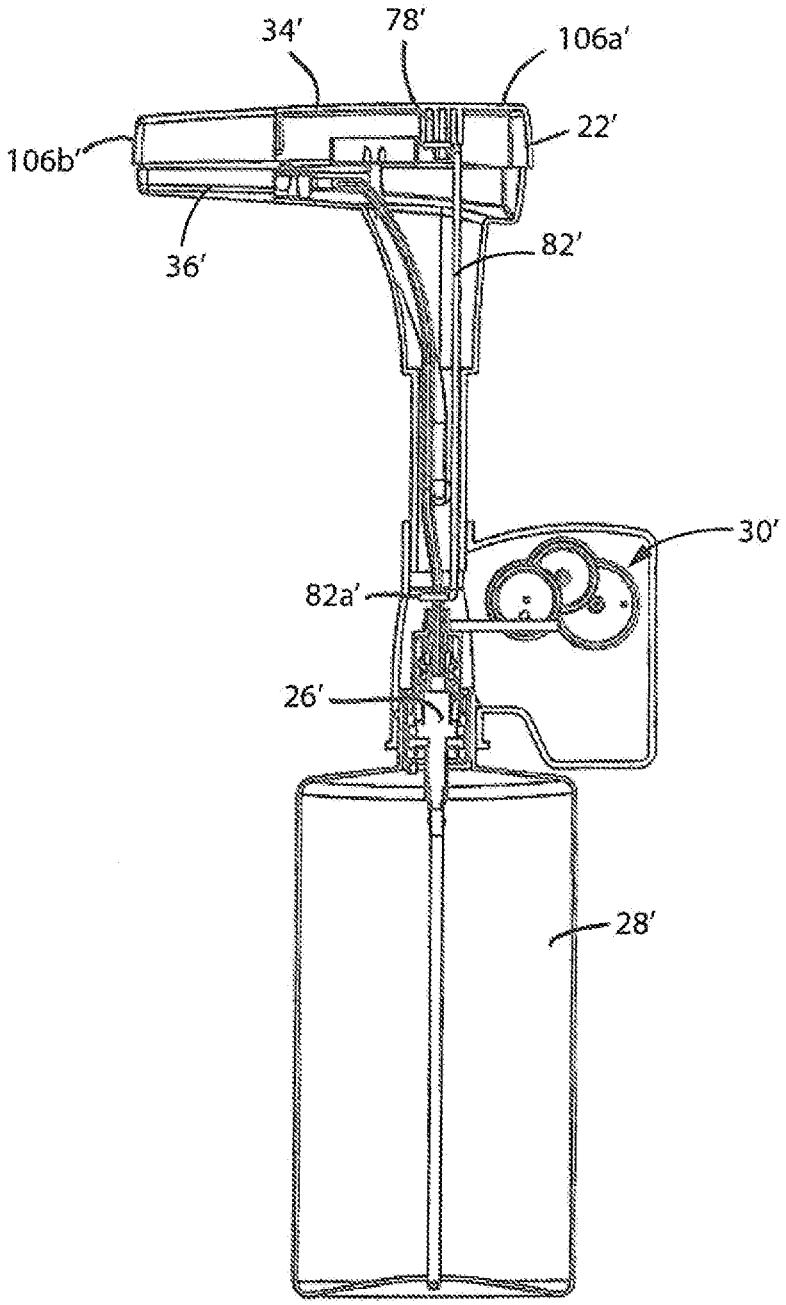
FIG. 14 is a view of the fluid dispensing apparatus of FIG. 13 showing a second position of the actuator component of the drive system in an automatic mode.
Figure 15:
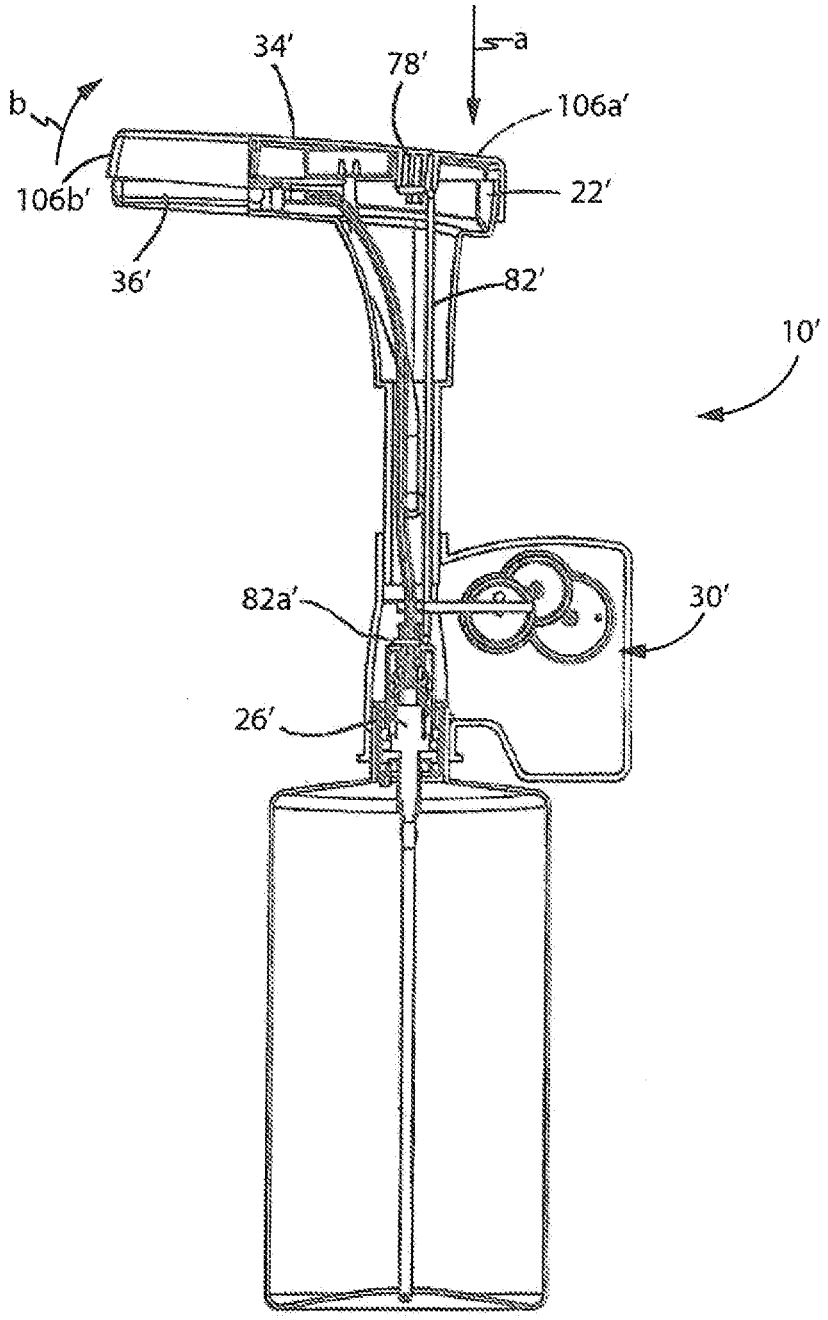
FIG. 15 is a partial cross-sectional view of the fluid dispenser apparatus of FIG. 13 showing the push element in a downward position for a manual actuation of the apparatus.
Figure 16:
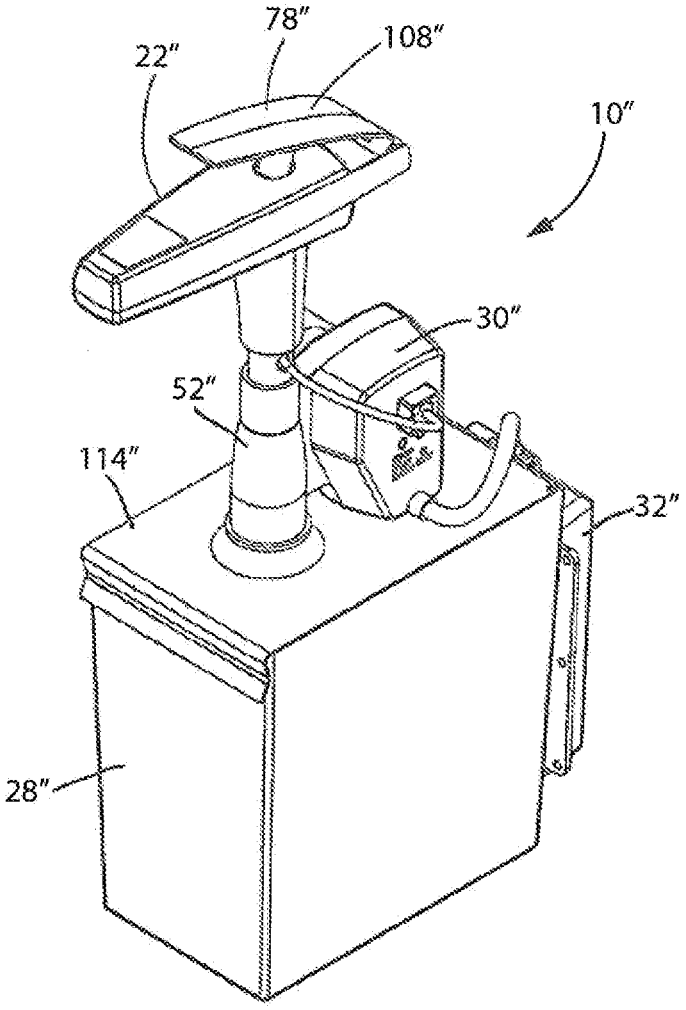
FIG. 16 is a side elevational view of another embodiment of a fluid dispensing apparatus according to the disclosure, mounted on a hinged cover of a container.
Figure 17:
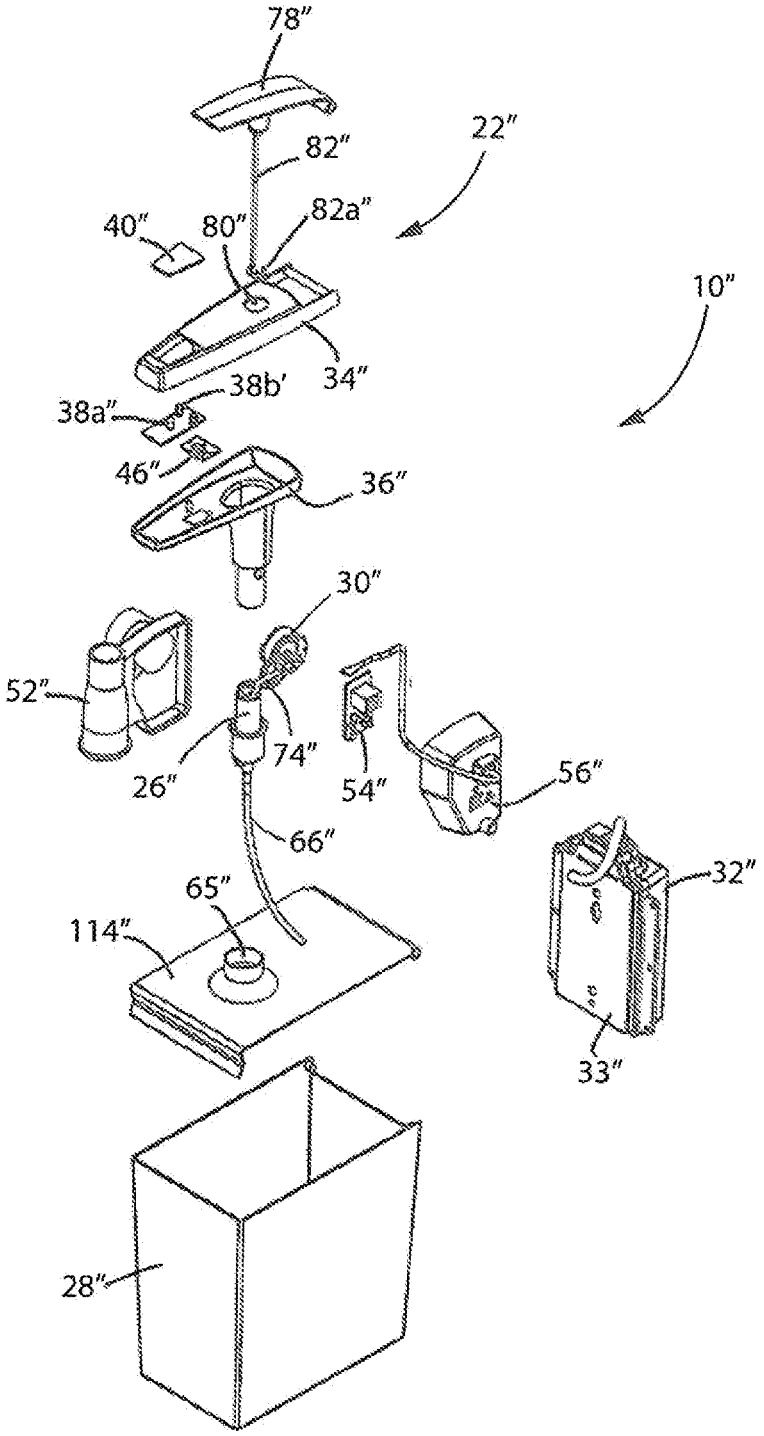
FIG. 17 is an exploded view of the fluid dispensing apparatus of FIG. 16.
Figure 18:
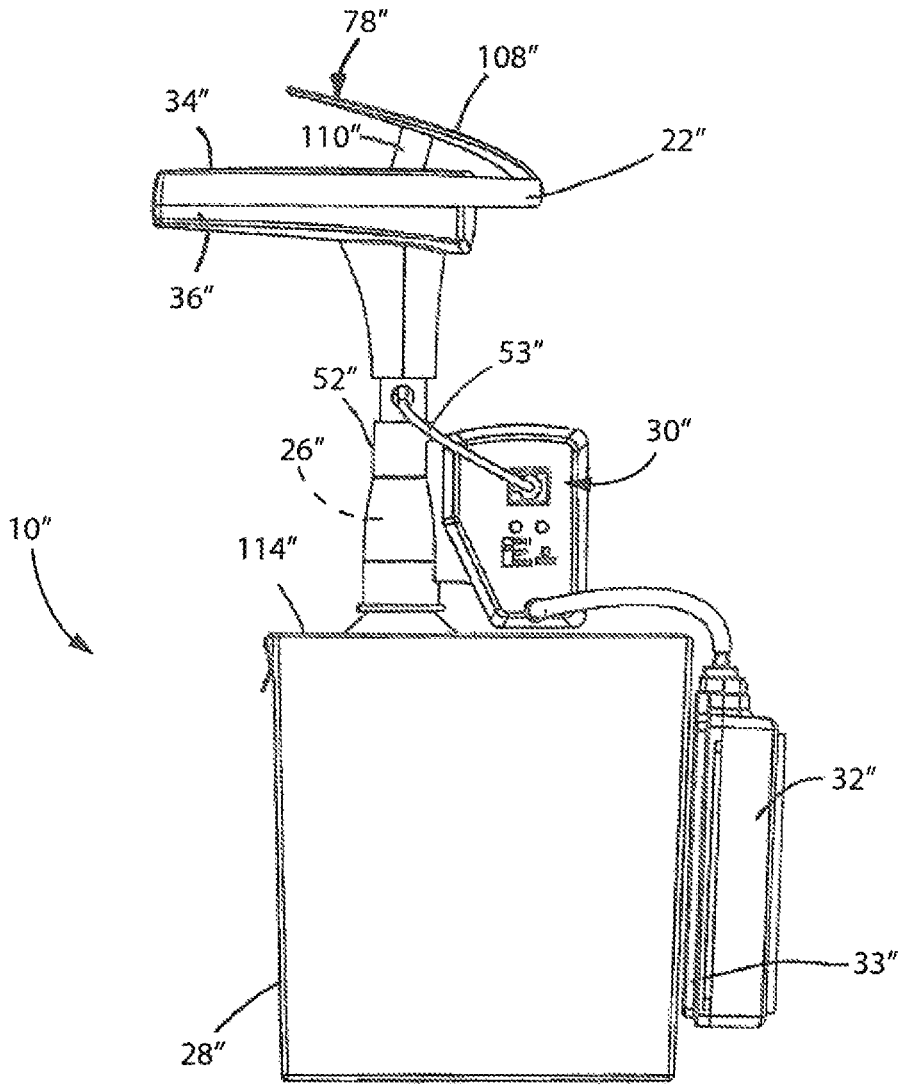
FIG. 18 is a side elevational view of the fluid dispensing apparatus of FIG. 16.
Figure 19:
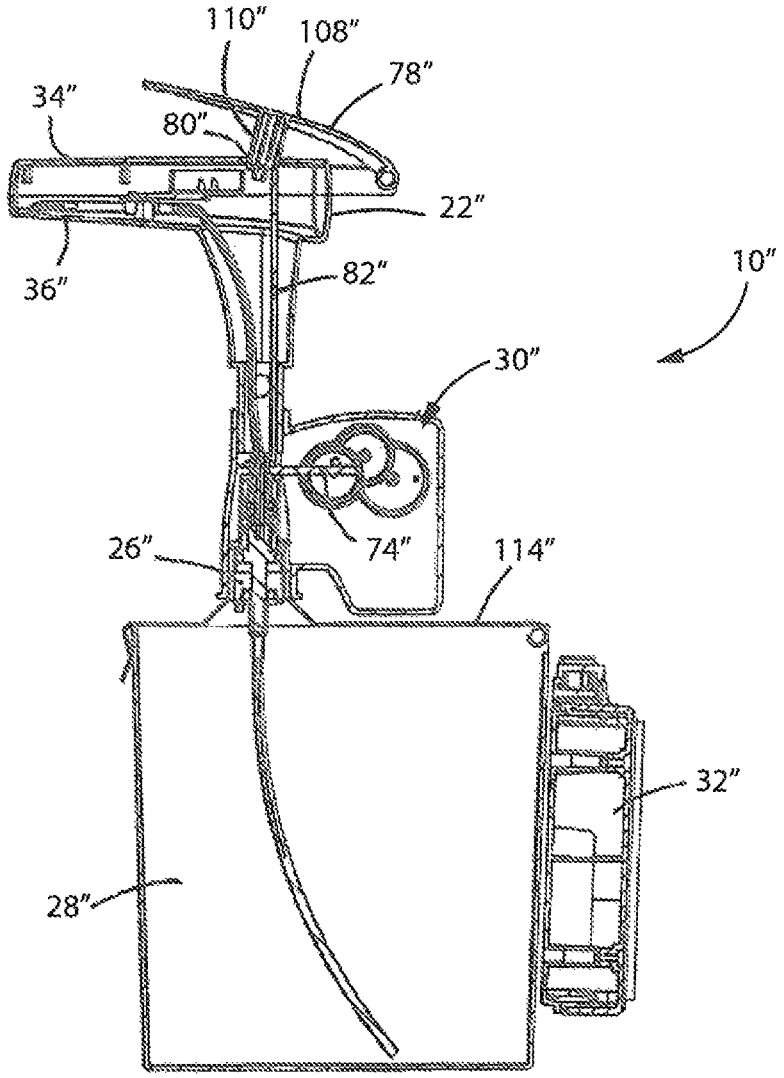
FIG. 19 is a cross-sectional view of the container and fluid dispensing apparatus of FIG. 18, showing a first position of the actuator component of the drive system in an automatic mode.
Figure 20:
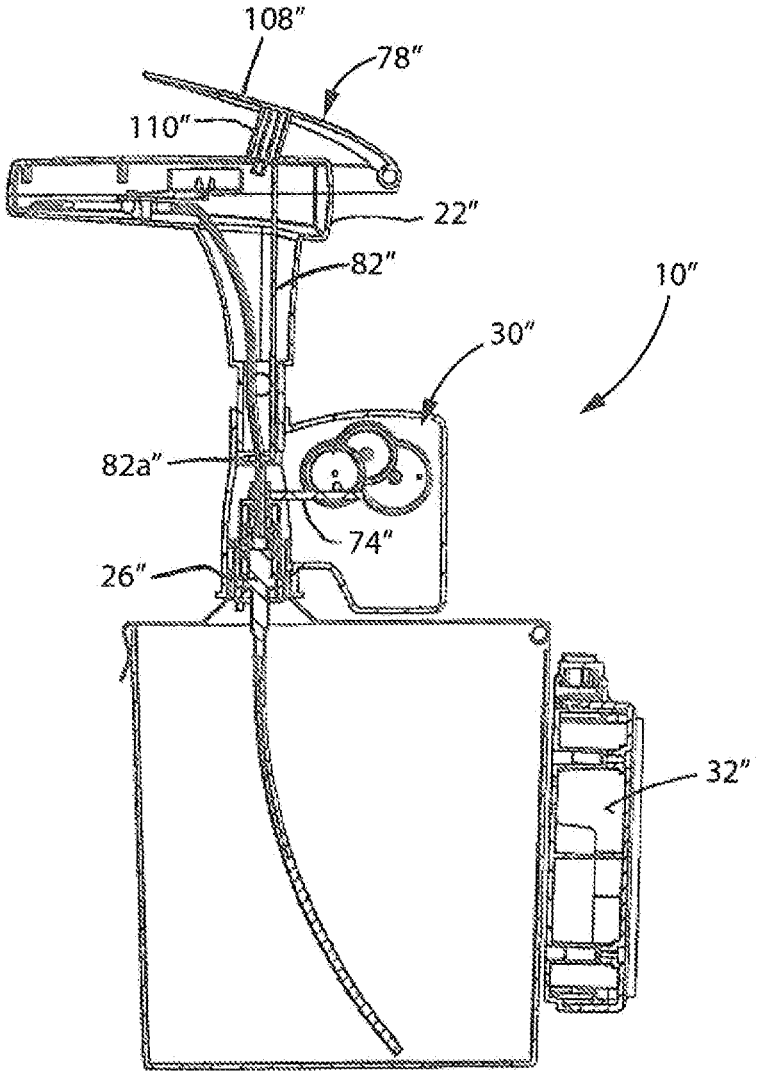
FIG. 20 is a view of the container and fluid dispensing apparatus of FIG. 19 showing a second position of the actuator component of the drive system in an automatic mode.

Referring now to FIGS. 12-15, in another embodiment, the fluid dispensing apparatus 10' can be structured with a spout assembly 22' in which the manually activated push element comprises a push element 78' attached on an inside surface of the cover section 34' at the proximal end 106*a*' of the spout assembly. In an automatic mode, the apparatus 10' operates as previously described with respect to the embodiment described in FIGS. 1-9, with the cover section 34' and connected base section 36' maintained substantially stationary in a horizontal plane, as shown in FIGS. 12-14. As depicted in FIG. 15, in a manual mode, the apparatus 10' is activated by pushing downward (arrow a) onto the cover 34' and the push element 78' which causes the distal end 106*b*' of the cover to pivot upward (arrow b) and the push element 78' and attached activation rod 82' (with end 82*a*' attached to the fluid pump 26') to move downwardly in a vertical axis to depress the fluid pump 26' downward and dispense the fluid.

Figure 21:
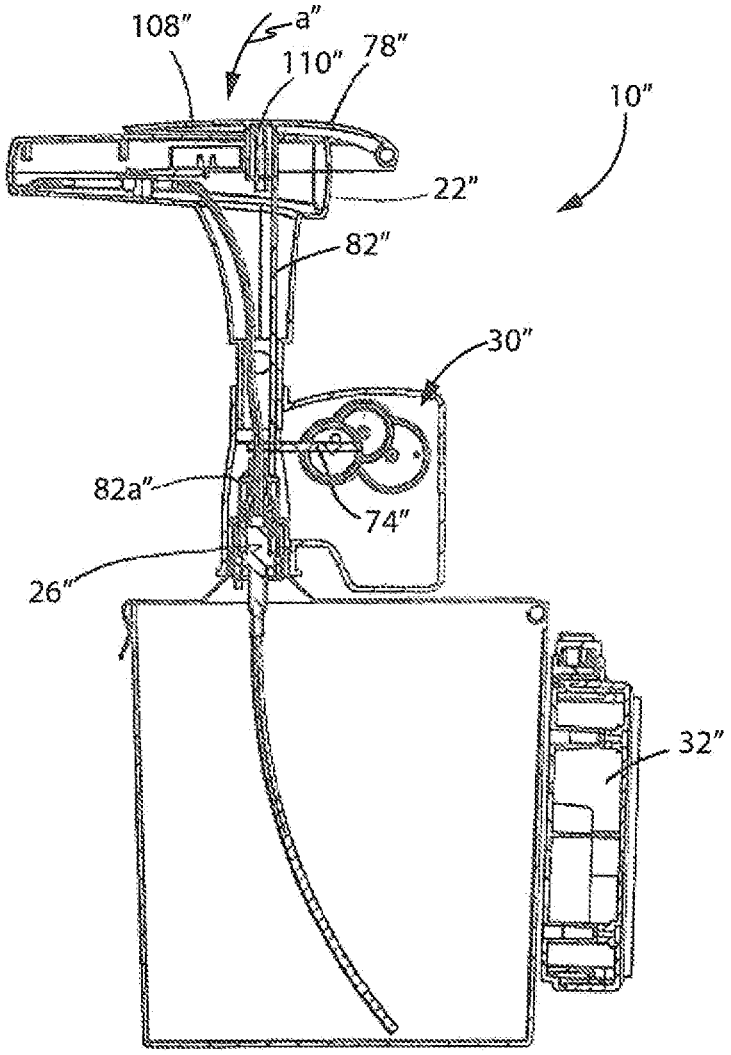
FIG. 21 is cross-sectional view of the fluid dispenser apparatus of FIG. 19 showing the push element in a downward position for a manual actuation of the apparatus.

FIGS. 16-22 illustrate another embodiment of a manually activated push element 78" of the spout assembly 22". As shown, the manually activated push element 78" is structured as a depressible lever component 108" that is mounted on the cover section 34". The lever component 108" includes a push component 110" that extends into an opening 80" in the cover section 34". In automatic mode, the lever component 108" is in an elevated or raised position, and the drive system 30" with movement of the connected actuator component 74" (e.g., rod) operates to dispense the fluid. As depicted in FIG. 21, for manual mode, the lever component 108" is pressed down to cause the (arrow a") push component 110" and attached activation rod 82" to move in a vertical axis downwardly and upwardly to move the fluid pump 26" for dispensing the fluid.

Figure 2:
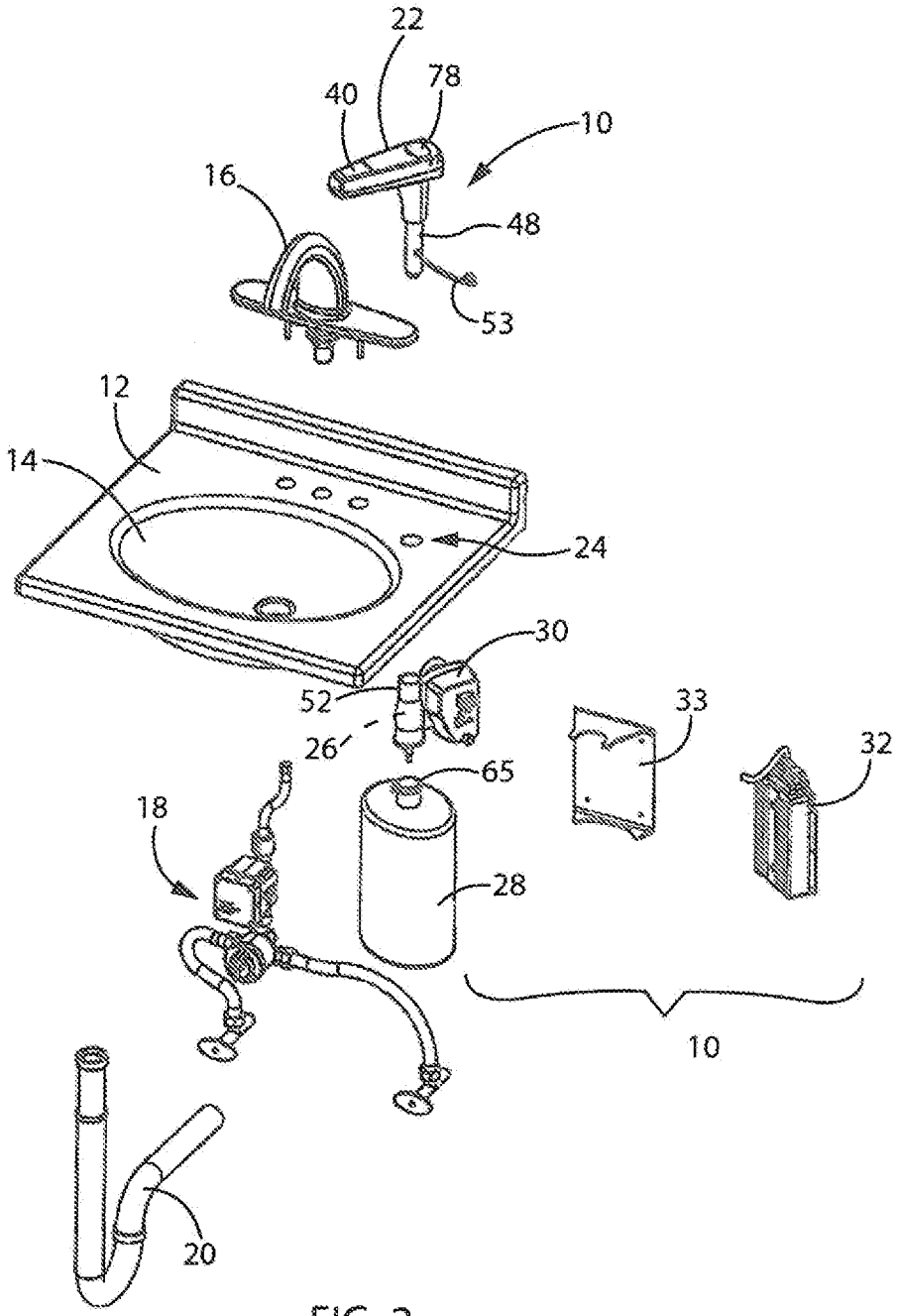
FIG. 2 is an exploded view of the fluid dispensing apparatus and sink components of FIG. 1.
Figure 3:
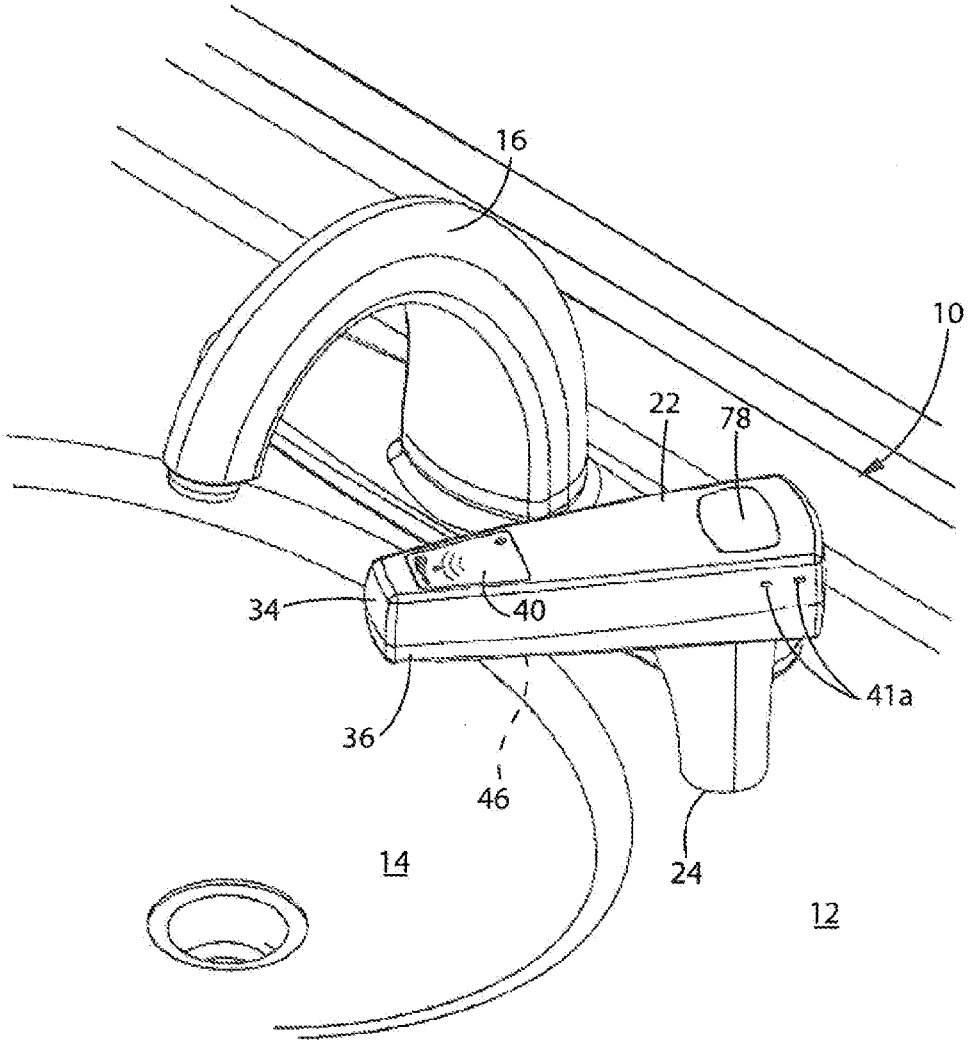
FIG. 3 is a partial perspective view of the sink and fluid dispensing apparatus depicted in FIG. 1.

In embodiments, the hybrid fluid dispensing apparatus can be mounted on a variety of support substrates such as a sink or counter of a sink as depicted in FIGS. 1-2. In other embodiments, the dispensing apparatus can be mounted on a container, as illustrated in FIGS. 16-21 that contains a fluid such as soap or other cleaning fluid, or a condiment such as catsup, mustard, etc. As depicted, the dispensing apparatus 10" can be mounted on a hinged cover 114" of the fluid container 28" having an opening 65". As shown, the drive system 30" can be positioned on the cover 114" and the power source 32" installed in a bracket 33" attached to a back panel of the container 28".

Figure 22:
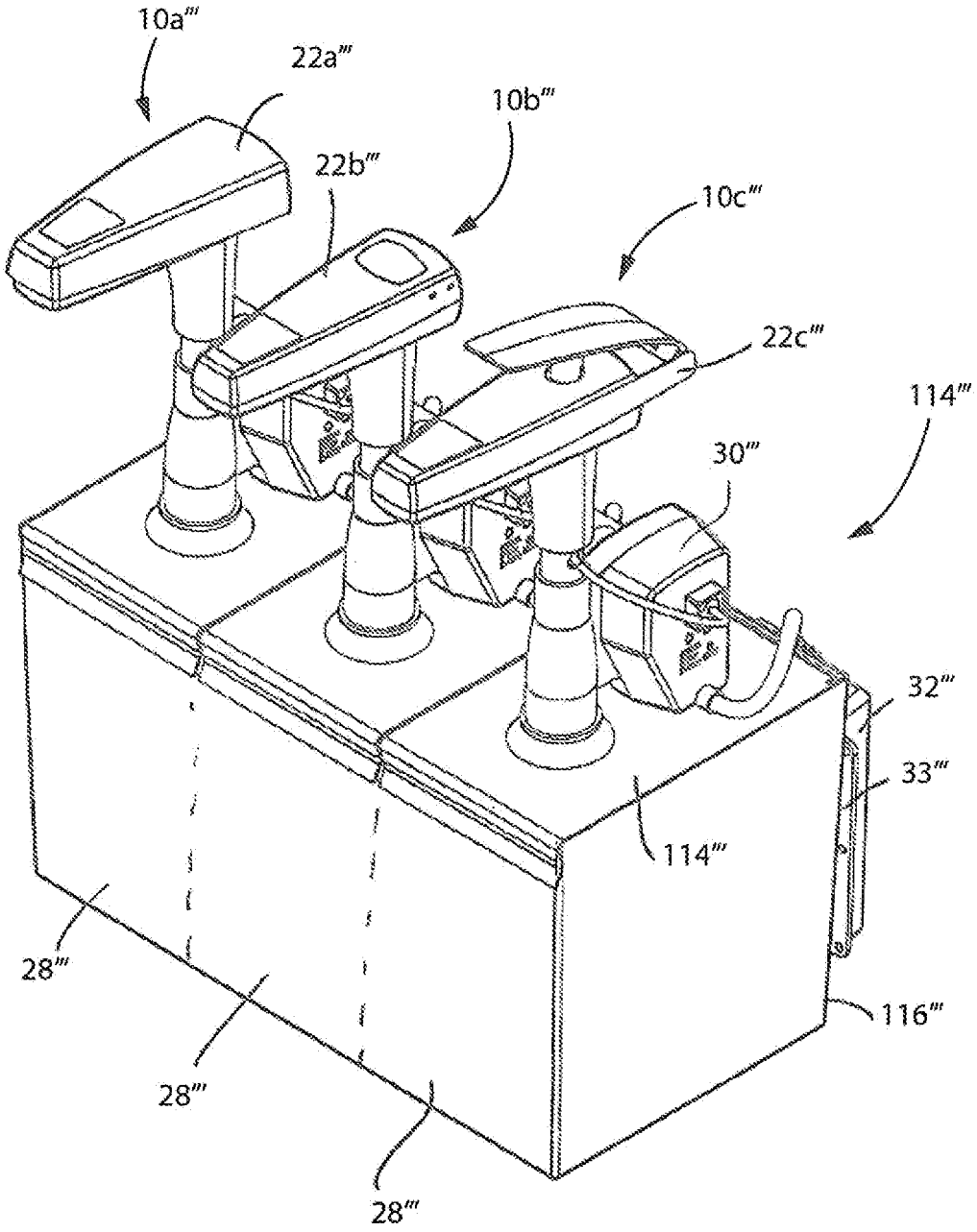
FIG. 22 is a perspective view of an embodiment of a container with a plurality of fluid dispensing apparatus according to the disclosure mounted on a hinged cover of the container.
Figure 23:
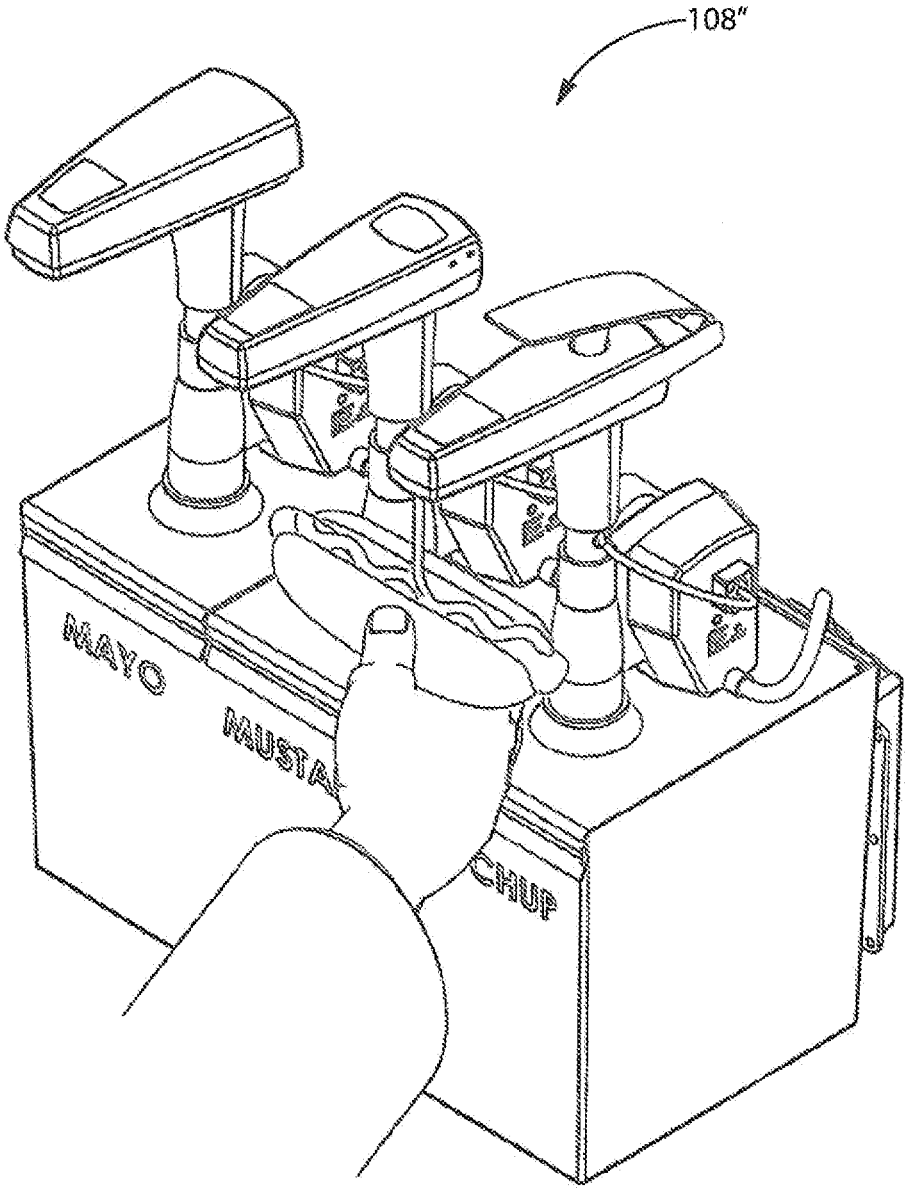
FIG. 23 is a perspective view of the container shown in FIG. 22 in use in an automatic mode.

FIGS. 22-23 illustrate another embodiment of a container dispenser 10''' composed of base portion 116''' with multiple compartments 28''', each with a separate dispensing apparatus

10*a-c*''' with the spout assembly 22*a-c*''' mounted through a hinged cover 114''' as the support substrate, which encloses a fluid within each compartment 28''' (or in some embodiments, a single, unitary fluid compartment). As illustrated in FIG. 23, the container can contain different fluids, for example, condiments, which can be dispensed automatically or manually onto a food item, as described hereinabove.

It is specifically intended that the present disclosure not be limited to the embodiments and illustrations contained herein, but include modified forms of those embodiments including portions of the embodiments and combinations of elements of different embodiments as come within the scope of the following claim.

We claim:

1. An apparatus for automatically and manually dispensing a fluid, comprising:

a spout assembly mounted through a support substrate and connected to a depressible fluid pump, the fluid pump mounted on a fluid container;

the spout assembly structured with a manually activated push element, and comprising a cover section hinged to a base section such that the cover section can be lifted upwardly, the cover section comprising one or more indicator lights, and the base section comprising an infrared sensor, an exit opening for dispensing the fluid therethrough and a bottom open end mounted on a housing for the fluid pump;

a first end of the fluid pump connected to a first extension tube inserted into the fluid container and a second end of the fluid pump connected to a second extension tube connected to the exit opening in the base section of the spout assembly for passage of fluid therethrough;

the fluid pump connected to a drive system connected to a power source, the drive system comprising an actuator component configured to engage and depress the fluid pump; and the manually activated push element of the spout assembly connected to an activation rod connected to the fluid pump;

wherein in an automatic operation, upon actuation of the drive system, the actuator component engages and depresses the fluid pump downwardly to cause an amount of fluid to flow out of the container into the fluid pump and through the exit opening of the spout assembly; and in a manual operation, upon manual activation of the push element, the activation rod moves downwardly along a vertical axis to downwardly move the fluid pump downwardly to cause an amount of fluid to flow out of the container into the fluid pump and through the exit opening of the spout assembly.

2. The apparatus of claim 1, wherein the actuator component and the activation rod are not connected and operate independently to depress the fluid pump.

3. The apparatus of claim 1, further comprising a container seating element positioned within the spout assembly being configured to receive an end of a container therein, the container seating element having an opening and a tubular element having a first end attached at the opening of the seating element and a second end attached at an opening into the fluid container for fluid flow therethrough into the fluid container.

4. The apparatus of claim 3, wherein the container seating element further comprises one or more piercing elements configured to perforate a cover of the fluid container.

5. The apparatus of claim 3, wherein the container seating element is configured with an internal fastening feature for matingly engaging an external fastening feature on the end of the container.

6. The apparatus of claim 1, further comprising a processor connected to the power source, the infrared sensor in the base section of the spout assembly, and the indicator lights, wherein the processor is configured to process and generate signals to activate or turn off an indicator light to illuminate an overlying symbol or wording for manual activation of the push element of the spout assembly.

7. The apparatus of claim 1, wherein the manually activated push element comprises a push button exposed through an opening in the cover section of the spout assembly.

8. The apparatus of claim 1, wherein the manually activated push element of the spout assembly comprises a push element on an inside surface of the cover section and connected to the activation rod, and the cover is pivotable in an upward and downward direction to move the activation rod along a vertical axis and downwardly move the fluid pump.

9. The apparatus of claim 1, wherein the manually activated push element of the spout assembly comprises a depressible lever mounted on the cover section and connected to the activation rod such that pressing down on the lever causes the activation rod to be moved downwardly to move the fluid pump.

10. The apparatus of claim 1, wherein the fluid pump is a metering pump.

11. The apparatus of claim 1, wherein the drive system comprises a pump motor connected to a rotatable gear, and the actuator component comprises a rod in a horizontal plane connected to the gear such that rotation of the gear moves the rod horizontally in a downward or upward direction.

12. The apparatus of claim 1, wherein the support substrate comprises a sink, a counter of a sink, or a container.

13. The apparatus of claim 12, wherein the support substrate comprises a hinged cover enclosing the fluid container with the spout assembly mounted through the cover.

14. The apparatus of claim 13, wherein the fluid container contains a condiment.

15. The apparatus of claim 13, wherein the fluid container contains a cleaning fluid.

16. A. system for dispensing one or more fluids, comprising:

two or more separate adjacently connected fluid containers, each of the fluid containers having a hinged cover enclosing the fluid container, and each of the fluid containers comprising an apparatus for automatically and manually dispensing a fluid therefrom, the apparatus comprising:

a spout assembly mounted through the hinged cover and connected to a fluid pump;

the spout assembly structured with a manually activated push element, and comprising a cover section hinged to a base section such that the cover section can be lifted upwardly, the cover section comprising one or more indicator lights, and the base section comprising a proximity sensor, an exit opening for dispensing the fluid therethrough and a bottom open end mounted on a housing for the fluid pump;

the fluid pump connected to a drive system connected to a power source, the drive system comprising an actuator component configured to engage and depress the fluid pump;

a first tubular element connecting the fluid pump to the exit opening in the base section of the spout assembly for passage of fluid therethrough, and a second tubular element connecting the fluid pump to fluid within the fluid container; and the manually activated, push element of the spout assembly connected to an activation rod connected to the fluid pump;

wherein in an automatic operation, upon actuation of the drive system, the actuator component engages and depresses the fluid pump downwardly to cause an amount of fluid to flow out of the container through the second tubular element and into the first tubular element and through the exit opening of the spout assembly; and in a manual operation, upon manual activation of the push element, the activation rod moves downwardly along a vertical axis to move the fluid pump downwardly to cause an amount of fluid to flow out of the container through the second tubular element and into the first tubular element and through the exit opening of the spout assembly.

* * * * *

UNITED STATES PATENT AND TRADEMARK OFFICE

CERTIFICATE OF CORRECTION

PATENT NO. : 8,950,628 B2
APPLICATION NO. : 13/842495
DATED : February 10, 2015
INVENTOR(S) : Todd J. Muderlak et al.

It is certified that error appears in the above-identified patent and that said Letters Patent is hereby corrected as shown below:

IN THE CLAIMS

Claim 16, column 8, line 43, after "A" delete ".";

Claim 16, column 9, line 4, after "activated" delete ",".

Signed and Sealed this
Second Day of June, 2015

Michelle K. Lee

Michelle K. Lee
*Director of the United States Patent and Trademark Office*